US012398332B2

(12) United States Patent
Mathur et al.

(10) Patent No.: US 12,398,332 B2
(45) Date of Patent: Aug. 26, 2025

(54) PROCESS FOR CONVERTING OLEFINS TO JET FUEL WITH PARALLEL REACTORS

(71) Applicant: UOP LLC, Des Plaines, IL (US)

(72) Inventors: Ashish Mathur, Gurgaon (IN); Debanjan Chakrabarti, Arlington Heights, IL (US); Joel S. Paustian, Vernon Hills, IL (US); Jeannie Mee Blommel, Oregon, WI (US); Richard K. Hoehn, Mount Prospect, IL (US)

(73) Assignee: UOP LLC, Rosemont, IL (US)

( * ) Notice: Subject to any disclaimer, the term of this patent is extended or adjusted under 35 U.S.C. 154(b) by 0 days.

(21) Appl. No.: 18/799,966

(22) Filed: Aug. 9, 2024

(65) Prior Publication Data

US 2025/0059452 A1 Feb. 20, 2025

Related U.S. Application Data

(60) Provisional application No. 63/520,061, filed on Aug. 16, 2023.

(51) Int. Cl.
*C10G 50/00* (2006.01)

(52) U.S. Cl.
CPC ..... *C10G 50/00* (2013.01); *C10G 2300/1092* (2013.01); *C10G 2300/70* (2013.01); *C10G 2400/08* (2013.01)

(58) Field of Classification Search
CPC .... C07C 2/24; C07C 2/12; C07C 5/03; C10L 1/06; C10L 2270/04; C10G 50/00; C10G 2300/1092; C10G 2300/70; C10G 2400/08
See application file for complete search history.

(56) References Cited

U.S. PATENT DOCUMENTS 4,414,423 A * 11/1983 Miller ..... C07C 2/12 585/533
4,497,968 A * 2/1985 Wright ..... C07C 2/12 585/533
4,569,827 A * 2/1986 Wright ..... C07C 2/12 422/612
2017/0327437 A1* 11/2017 Hwang ..... C10G 50/00

* cited by examiner

*Primary Examiner* — Ali Z Fadhel
(74) *Attorney, Agent, or Firm* — Paschall & Associates, LLC; James C. Paschall

(57) ABSTRACT

A process for oligomerizing an olefin stream comprising charging a light olefin vapor stream comprising ethylene to a first oligomerization reactor containing a first oligomerization catalyst to produce a first oligomerized stream. A heavy olefin liquid stream comprising C3-C8 olefin liquids stream is charged to a second oligomerization reactor containing a second oligomerization catalyst to produce a second oligomerized stream. The two oligomerized streams can be processed to recover fuel streams together.

20 Claims, 2 Drawing Sheets

PROCESS FOR CONVERTING OLEFINS TO JET FUEL WITH PARALLEL REACTORS

The field is the conversion of olefins to distillate. The field may particularly relate to oligomerizing olefins to distillate fuels.

BACKGROUND

Molecular sieves such as microporous crystalline zeolite and non-zeolitic catalysts, particularly silicoaluminophosphates (SAPO), are known to promote the conversion of oxygenates such as methanol to light olefins. The highly efficient Methanol to Olefin (MTO) process may convert oxygenates to light olefins which had been typically considered for plastics production. Light olefins produced from the MTO process is highly concentrated in ethylene and propylene.

The ethanol dehydration process involves dehydration of ethanol molecules to generate ethylene and water. The process of converting ethanol to ethylene is endothermic in nature and the heat of endothermicity is typically provided by fired heaters that are adiabatic in nature. Dehydration reactors are adiabatic. Adiabatic reactor systems may have drawbacks such as selectivity to undesired products, potential underutilization of catalyst, higher utility consumption and larger plot space.

Ethylene can be dimerized and oligomerized into olefins such as C4, C6 and C8 olefins. Propylene can be dimerized and oligomerized into olefins such as C6, C9 and C12 olefins. Olefin oligomerization is a process that can oligomerize smaller olefins into larger olefins. More specifically, it can convert olefins including dimerized olefins into distillates including jet fuel and diesel range products. The oligomerized distillate can be saturated for use as transportation fuels.

Jet fuel is one of the few petroleum fuels that cannot be replaced easily by electrical motor systems because a high energy output is required to fuel planes which cannot be supplied with electric motors. Jet fuel has an end point boiling specification of less than 300° C. using ASTM D86. Large incentives are currently available for green jet fuel in certain regions.

An efficient process is desired for converting renewable feeds to distillate fuels.

BRIEF SUMMARY

We have formulated a process for oligomerizing an olefin stream to distillate fuel. A process for oligomerizing an olefin stream comprising charging a light olefin vapor stream comprising ethylene to a first oligomerization reactor containing a first oligomerization catalyst to produce a first oligomerized stream. A heavy olefin liquid stream comprising a C3-C8 olefin liquid stream is charged to a second oligomerization reactor containing a second oligomerization catalyst to produce a second oligomerized stream. The two oligomerized streams can be processed to recover fuel streams together.

DEFINITIONS

Figure 1:
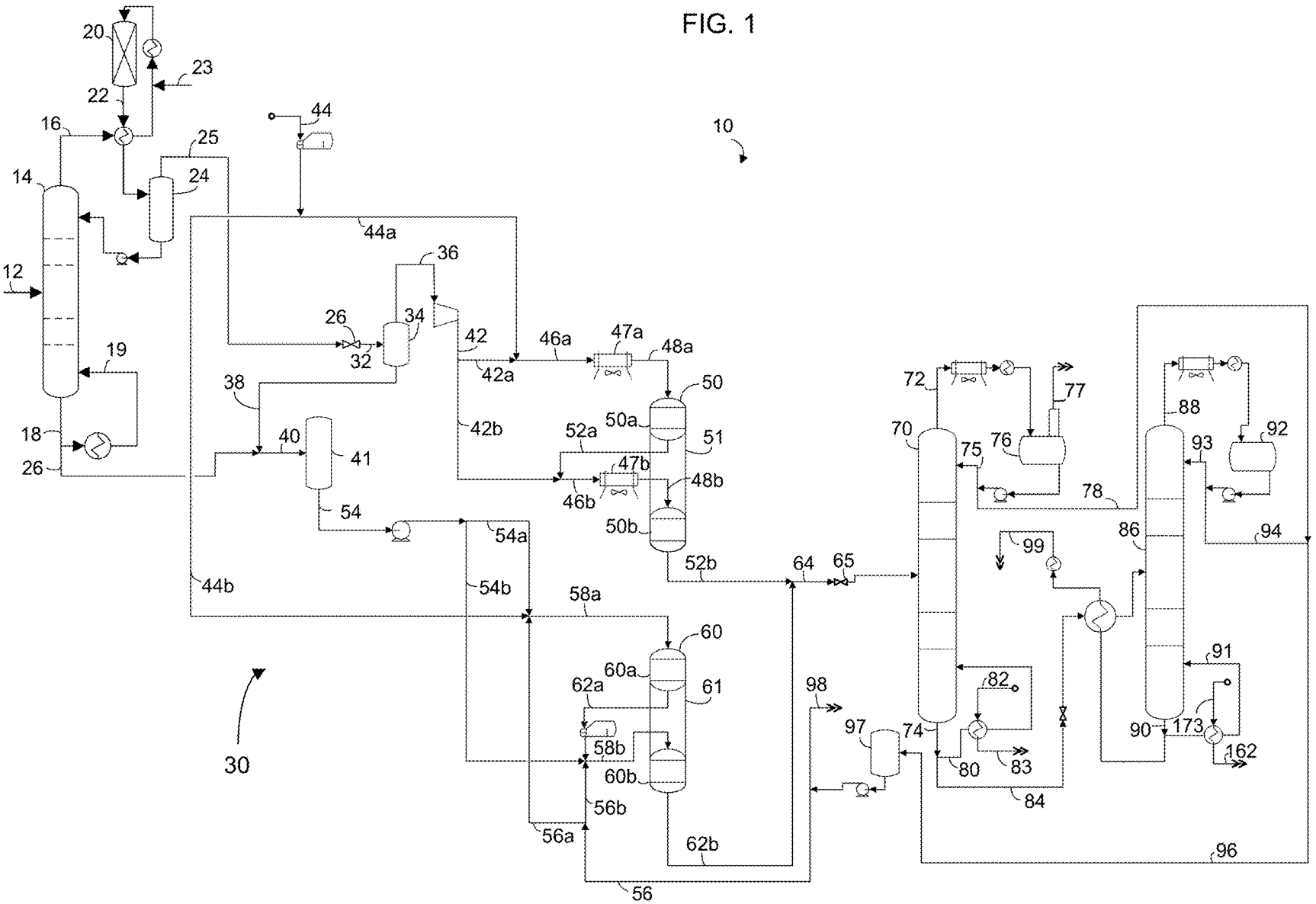
FIG. 1 is a schematic drawing of an oligomerization section of a process and apparatus of the present disclosure.

The term "communication" means that fluid flow is operatively permitted between enumerated components, which may be characterized as "fluid communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "bypass" means that the object is out of downstream communication with a bypassing subject at least to the extent of bypassing.

As used herein, the term "predominant" or "predominate" means greater than 50%, suitably greater than 75% and preferably greater than 90%.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripping columns may omit a reboiler at a bottom of the column and instead provide heating requirements and separation impetus from a fluidized inert media such as steam. Stripping columns typically feed a top tray and take main product from the bottom.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure. As used herein, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures".

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5", "T90" or "T95" means the temperature at which 5 mass percent, 90 mass percent or 95 mass percent, as the case may be, respectively, of the sample boils using ASTM D-86 or TBP.

As used herein, the term "initial boiling point" (IBP) means the temperature at which the sample begins to boil using ASTM D-7169, ASTM D-86 or TBP, as the case may be.

As used herein, the term "end point" (EP) means the temperature at which the sample has all boiled off using ASTM D-7169, ASTM D-86 or TBP, as the case may be.

As used herein, the term "diesel" means hydrocarbons boiling in the range of an IBP between about 125° C. (257° F.) and about 175° C. (347° F.) or a T5 between about 150° C. (302° F.) and about 200° C. (392° F.) and the "diesel cut point" comprising a T95 between about 343° C. (650° F.) and about 399° C. (750° F.) using the TBP distillation method or a T90 between 280° C. (536° F.) and about 340° C. (644° F.) using ASTM D-86. The term "green diesel" means diesel comprising hydrocarbons not sourced from fossil fuels.

As used herein, the term "jet fuel" means hydrocarbons boiling in the range of a T10 between about 190° C. (374° F.) and about 215° C. (419° F.) and an end point of between about 290° C. (554° F.) and about 310° C. (590° F.). The term "green jet fuel" means jet fuel comprising hydrocarbons not sourced from fossil fuels.

DETAILED DESCRIPTION

The process disclosed involves dimerizing a light olefin stream comprising ethylene and oligomerizing a heavy olefin stream comprising C3+ olefins followed by joint downstream processing of the respective oligomerization streams. The approach takes account that ethylene and higher olefins require different treatments for effective oligomerization. The process and apparatus may include an oligomerization section 10 illustrated in FIG. 1 and a hydrogenation section 110 as illustrated in FIG. 2.

Figure 2:
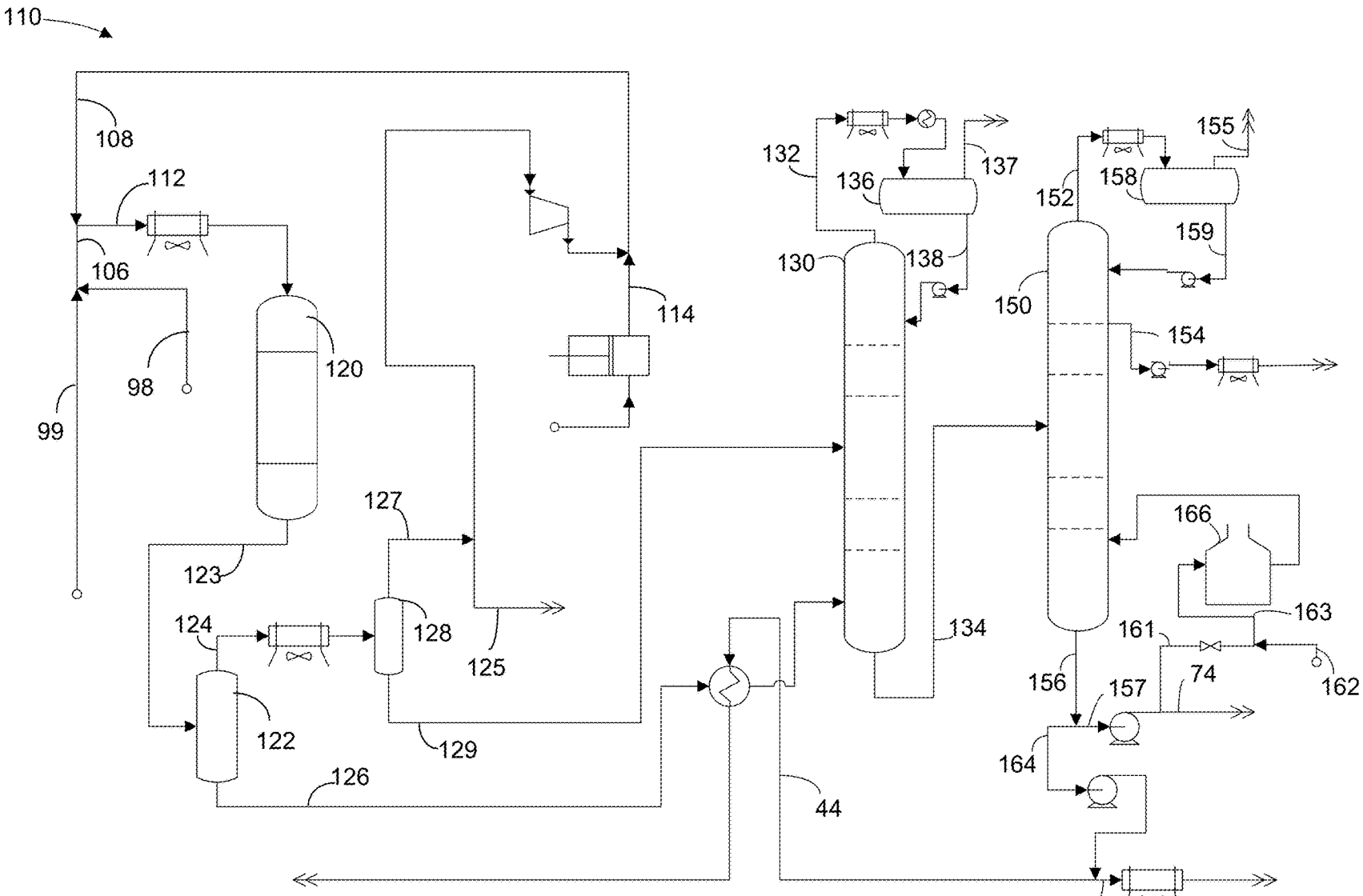
FIG. 2 is a schematic drawing of a hydrogenation section of a process and apparatus of the present disclosure.

Turning to the oligomerization section 10 of FIG. 1, a preliminary olefin stream in feed line 12 may be obtained from a methanol to olefins process or from an ethanol dehydration process. The preliminary olefin stream in feed line 12 may be deethanized by fractionation in a deethanizer column 14 to provide an ethylene stream in a net overhead line 16 and a fractionated C3+ olefin stream in a deethanized net bottoms line 18. The deethanizer column 14 may be operated at a bottom temperature of about 43° C. (110° F.) to about 104° C. (220° F.) and an overhead pressure of about 2.1 MPa (gauge) (300 psig) to about 3.5 MPa (gauge) (500 psig).

An ethylene overhead stream in an overhead line 16 may be heated by heat exchange with a concentrated ethylene stream in line 22 and combined with a hydrogen stream from line 23 to provide a combined ethylene overhead stream, further heated and charged to an acetylene conversion reactor 20. In the acetylene conversion reactor 20, acetylenes are converted to ethylene over an acetylene conversion catalyst in the presence of hydrogen thereby producing a concentrated ethylene stream in line 22. The concentrated ethylene stream in line 22 is condensed by heat exchange with the ethylene overhead stream in the overhead line 16 and further condensed. The further condensed concentrated ethylene stream is separated in a deethanizer receiver 24 to provide a light olefin stream in the vapor phase in the net overhead line 25 and a condensed liquid stream in a reflux line from a bottom of the deethanizer receiver 24 which may be refluxed back to the deethanizer column 14. The deethanized stream in the bottoms line 18 may be split between a reboil stream which is reboiled and returned boiling in a reboil line 19 to the deethanizer column 14 to provide heating requirements. The acetylene conversion catalyst may be a palladium and silver on aluminum oxide catalyst. The acetylene conversion conditions may include a pressure of about 1.4 MPa (gauge) (200 psig) to about 2.8 MPa (gauge) (400 psig) and a temperature of about 38° C. (100° F.) to about 93° C. (200° F.).

The fractionated heavy olefin stream in the net bottoms line 26 may contain oxygenates such as dimethyl ether and diolefins that may be removed. The oxygenates may be removed by a water wash and/or an adsorption unit and the diolefins may be removed by selective hydrogenation.

The light olefin stream in line 25 and the heavy olefin stream in line 26 may be delivered to the oligomerization section 10. The light olefin stream in line 25 may comprise substantial ethylene. The light olefin stream may predominantly comprise ethylene. In an aspect, the light olefin stream may comprise at least 95 mol % ethylene. The light olefin stream in line 25 may be styled an ethylene stream. The light olefin stream may be provided by the dehydration of ethanol or be provided from a MTO unit. The light olefin stream may be at a temperature of about 60° C. (140° F.) to about 150° C. (302° F.), preferably about 80° C. (176° F.) to about 100° C. (212° F.), and a pressure of about 3.5 MPag (500 psig), preferably about 5.6 MPag (800 psig) to about 8.4 MPag (1200 psig). The light olefin stream in line 25 may be expanded over a throttle valve 26 to provide an expanded light olefin stream in line 32. The expanded light olefin stream may be separated in a separator 34 such as a knock-out drum to provide a dry light olefin stream in an overhead line 36 and a light liquid stream in the bottoms line 38. The light liquid stream in line 38 may be added to the heavy olefin stream in line 26 to provide a supplemented heavy olefin stream in line 40.

The dry light olefin stream in the overhead line 36 may be compressed up to oligomerization pressure to provide a compressed light olefin stream in a charge line 42 before it is charged to the first oligomerization reactor 50.

The light olefin stream may be contacted with a first oligomerization catalyst to oligomerize the ethylene to dimers and oligomers. The oligomerization reaction generates a large exotherm. For example, dimerization of ethylene can generate 612 kcal/kg (1100 BTU/lb) of heat. Consequently, this large exotherm must be managed. Accordingly, the compressed light olefin stream in line 42 may be split into multiple olefin streams. In FIG. 1, the compressed light olefin stream is split into two separate streams: a first light olefin stream in a first light olefin line 42*a* and a second light olefin stream in a second light olefin line 42*b*. More or less separate multiple olefin streams may be used. Up to six light olefin streams are readily contemplated. The light olefin stream in line 42 may be split into equal aliquot multiple olefin streams. Alternatively, the light olefin stream in line 42 may be split into unequal streams. For example, the light olefin stream may be split into streams of descending flow rates in which a light olefin stream to a preceding reactor has a larger flow rate than a light olefin stream to a subsequent reactor. In an embodiment, the light olefin stream is split into two streams of equal flow rates, each comprising 50 vol % of the light olefin stream. In another embodiment, the first light olefin stream in the first light olefin line 42*a* may comprise about 70 to about 90 vol % of the light olefin stream and the second light olefin stream in the second olefin line 42*b* may comprise about 10 to about 30 vol % of the light olefin stream.

To further manage the exotherm, the light olefin stream may be diluted with a diluent stream to provide a dilute olefin stream to absorb the exotherm. The diluent stream may comprise a paraffin stream in a diluent line 44. The diluent stream in the diluent line 44 may be split into a first diluent stream in line 44*a* and a second diluent stream in line 44*b*. The first diluent stream in line 44*a* may be added to the first light olefin stream in the first light olefin line 42*a* before it is charged to the first oligomerization reactor 50. Preferably, the first diluent stream is added to the first light olefin stream in line 42*a* after the split of the light olefin stream in line 42 into multiple olefin streams to provide a first dilute olefin light stream in line 46*a*, so the diluent stream passes through all of the catalyst beds 50*a* and 50*b* in the first oligomerization reactor 50. Alternatively, the diluent stream may also be split into multiple streams with each diluent stream added to a corresponding light olefin stream. The diluent stream in line 44*a* may have a volumetric flow rate of about 2 to about 8 times and preferably about 3 to about 6 times the volumetric flow rate of the light olefin stream in line 42.

The first dilute light olefin stream may comprise no more than 35 wt % olefins, suitably no more than 30 wt % olefins and preferably no more than 20 wt % olefins. In an embodiment, the first dilute light olefin stream comprises about 10 to about 30 wt % C2 olefins. The first dilute light olefin stream may comprise no more than 30 wt % ethylene, suitably no more than 25 wt % ethylene and preferably no more than 20 wt % ethylene. In an embodiment, the first dilute charge olefin stream comprises no more than about 5 to about 10 wt % propylene.

The first oligomerization reactor 50 may comprise a series of first oligomerization catalyst beds 50*a* and 50*b*, each for charging with a dilute light olefin charge stream 46*a* and 46*b*, respectively. The first oligomerization reactor 50 preferably contains two fixed first light oligomerization catalyst beds 50*a* and 50*b*. It is also contemplated that each first oligomerization catalyst bed 50*a* and 50*b* may be in a dedicated first-stage oligomerization reactor or multiple first oligomerization catalyst beds may be in two or more separate first oligomerization reactor vessels. Up to six, first oligomerization catalyst beds are readily contemplated. In FIG. 1, one first oligomerization reactor vessel 51 is utilized with two catalyst beds 50*a* and 50*b*.

A parallel first oligomerization reactor may be used when the first oligomerization reactor 50 has deactivated during which the first oligomerization reactor 50 is regenerated in situ by combustion of coke from the catalyst. In another embodiment, each first oligomerization reactor may comprise a lead reactor, a lag reactor and a spare reactor to facilitate regeneration. The additional reactors are not shown in FIG. 1.

The first dilute light olefin stream in line 46*a* may be cooled in a first light charge cooler 47*a* to provide a cooled dilute first light olefin stream in line 48*a* and charged to a first bed 50*a* of first oligomerization catalyst in the first oligomerization reactor vessel 51 of the first oligomerization reactor 50. The cooled diluted first light olefin stream in line 48*a* may be charged at a temperature of about 80° C. (176° F.) to about 200° C. (392° F.) and a pressure of about 3.5 MPag (500 psig) to about 8.4 MPag (1200 psig). The charge cooler 47*a* may comprise a steam generator.

The diluted first light olefin stream may be charged to the first light oligomeriztion catalyst bed 50*a* in line 48*a* preferably in a down flow operation. However, upflow operation may be suitable. As oligomerization of ethylene occurs in the first oligomerization catalyst bed 50*a*, an exotherm is generated due to the highly exothermic nature of the ethylene oligomerization. Dimerization and oligomerization of the first light olefin stream produces a first light oligomerized stream in a first oligomerized line 52*a* at an elevated outlet temperature despite the cooling and dilution. The elevated outlet temperature is limited to between 150° C. (302° F.) and about 250° C. (482° F.).

The second light olefin stream in line 42*b* may be mixed with the first light oligomerized stream in the first oligomerized line 52*a* removed from the first light oligomerization catalyst bed 50*a* in the first oligomerization reactor 50 to provide a dilute second light olefin stream in line 46*b*. The first light oligomerized stream in line 52*a* includes the diluent stream from diluent line 44*a* added to the first light olefin stream in line 42*a*. The second light olefin stream may comprise no more than 35 wt % ethylene, suitably no more than 25 wt % ethylene and preferably no more than 20 wt % ethylene. The dilute second light olefin stream in line 46*b* may be cooled in a second charge cooler 47*b* which may be located externally to the first oligomerization reactor 50 to provide a cooled second light olefin stream in line 48*b* and charged to the second bed 50*b* of the first oligomerization catalyst in the first oligomerization reactor 50. The charge cooler 47*b* may comprise a steam generator.

The dilute second light olefin stream in line 48*b* may be charged at a temperature of about 80° C. (176° F.) to about 200° C. (392° F.) and a pressure of about 3.5 MPag (500 psig) to about 8.4 MPag (1200 psig). The dilute second light olefin stream will include diluent and ethylene from the first oligomerized stream. The unreacted ethylene from the first oligomerized stream will dimerize and oligomerize in the second catalyst bed 50*b*. Dimerization and oligomerization of ethylene and oligomers in the second light olefin stream in the second bed 50*b* of first oligomerization catalyst produces a second light oligomerized olefin stream in a second light oligomerized line 52*b* at an elevated outlet temperature. The elevated outlet temperature may be limited to between 30° C. (54° F.) and about 50° C. (90° F.) above the inlet temperature to the catalyst bed 50*b*.

The first oligomerization reaction takes place predominantly in the gas phase or in a mixed liquid and gas phase at a LHSV 0.5 to 10 $hr^{-1}$ on an olefin basis. We have found that across the first catalyst beds, typically a predominance of ethylene in the light olefin stream converts to higher olefins. The ethylene will initially dimerize over the catalyst to butenes.

The first oligomerization catalyst is preferably an amorphous silica-alumina base with a metal from either Group VIII and/or Group VIB in the periodic table using Chemical Abstracts Service notations. In an aspect, the catalyst has a Group VIII metal promoted with a Group VIB metal. Typically, the silica and alumina will only be in the base, so the silica-to-alumina ratio will be the same for the catalyst as for the base. The metals can either be impregnated onto or ion exchanged with the silica-alumina base. Co-mulling is also contemplated. Catalysts for the present invention may have a Low Temperature Acidity Ratio of at least about 0.15, suitably of about 0.2, and preferably greater than about 0.25, as determined by Ammonia Temperature Programmed Desorption (Ammonia TPD) as described hereinafter. Additionally, a suitable catalyst will have a surface area of between about 50 and about 400 $m^2/g$ as determined by nitrogen BET.

The preferred first oligomerization catalyst comprises an amorphous silica-alumina support. One of the components of the catalyst support utilized in the present disclosure is alumina. The alumina may be any of the various hydrous aluminum oxides or alumina gels such as alpha-alumina monohydrate of the bochmite or pseudo-bochmite structure, alpha-alumina trihydrate of the gibbsite structure, beta-alumina trihydrate of the bayerite structure, and the like. A particularly preferred alumina is available from Sasol North America Alumina Product Group under the trademark Catapal. This material is an extremely high purity alpha-alumina monohydrate (pseudo-bochmite) which after calcination at a high temperature has been shown to yield a high purity gamma-alumina. Another component of the catalyst support is an amorphous silica-alumina. A suitable silica-alumina with a silica-to-alumina ratio of 2.6 is available from CCIC, a subsidiary of JGC, Japan.

Another component utilized in the preparation of the first oligomerization catalyst utilized in the present invention is a surfactant. The surfactant is preferably admixed with the hereinabove described alumina and the silica-alumina powders. The resulting admixture of surfactant, alumina and silica-alumina is then formed, dried and calcined as hereinafter described. The calcination effectively removes by combustion the organic components of the surfactant but only after the surfactant has dutifully performed its function in accordance with the present invention. Any suitable surfactant may be utilized in accordance with the present invention. A preferred surfactant is a surfactant selected from a series of commercial surfactants sold under the trademark "Antarox" by Solvay S.A. The "Antarox" surfactants are generally characterized as modified linear aliphatic polyethers and are low-foaming biodegradable detergents and wetting agents.

A suitable silica-alumina mixture is prepared by mixing proportionate volumes silica-alumina and alumina to achieve the desired silica-to-alumina ratio. In an embodiment, about 75 to about 99 wt-% amorphous silica-alumina with a silica-to-alumina ratio of 2.6 and about 10 to about 20 wt-% alumina powder will provide a suitable support. In an embodiment, other ratios of amorphous silica-alumina to alumina may be suitable.

Any convenient method may be used to incorporate a surfactant with the silica-alumina and alumina mixture. The surfactant is preferably admixed during the admixture and formation of the alumina and silica-alumina. A preferred method is to admix an aqueous solution of the surfactant with the blend of alumina and silica-alumina before the final formation of the support. It is preferred that the surfactant be present in the paste or dough in an amount from about 0.01 to about 10 wt-% based on the weight of the alumina and silica-alumina.

Monoprotic acid such as nitric acid or formic acid may be added to the mixture in aqueous solution to peptize the alumina in the binder. Additional water may be added to the mixture to provide sufficient wetness to constitute a dough with sufficient consistency to be extruded or spray dried.

The paste or dough may be prepared in the form of shaped particulates, with the preferred method being to extrude the dough mixture of alumina, silica-alumina, surfactant and water through a die having openings therein of desired size and shape, after which the extruded matter is broken into extrudates of desired length and dried. A further step of calcination may be employed to give added strength to the extrudate. Generally, calcination is conducted in a stream of dry air at a temperature from about 260° C. (500° F.) to about 815° C. (1500° F.).

The extruded particles may have any suitable cross-sectional shape, i.e., symmetrical or asymmetrical, but most often have a symmetrical cross-sectional shape, preferably a spherical, cylindrical or polylobal shape. The cross-sectional diameter of the particles may be as small as 40 μm; however, it is usually about 0.635 mm (0.25 inch) to about 12.7 mm (0.5 inch), preferably about 0.79 mm (1/32 inch) to about 6.35 mm (0.25 inch), and most preferably about 0.06 mm (1/24 inch) to about 4.23 mm (1/6 inch).

Typical characteristics of the amorphous silica-alumina supports utilized herein are a total pore volume, average pore diameter and surface area large enough to provide substantial space and area to deposit the active metal components. The total pore volume of the support, as measured by conventional mercury porosimeter methods, is usually about 0.2 to about 2.0 cc/gram, preferably about 0.25 to about 1.0 cc/gram and most preferably about 0.3 to about 0.9 cc/gram. Ordinarily, the amount of pore volume of the support in pores of diameter greater than 100 angstroms is less than about 0.1 cc/gram, preferably less than 0.08 cc/gram, and most preferably less than about 0.05 cc/gram. Surface area, as measured by the B.E.T. method, is typically above 50 $m^2$/gram, e.g., above about 200 $m^2$/gram, preferably at least 250 $m^2$/gram., and most preferably about 300 $m^2$/gram to about 400 $m^2$/gram.

To prepare the first oligomerization catalyst, the support material is compounded, as by a single impregnation or multiple impregnations of a calcined amorphous refractory oxide support particles, with one or more precursors of at least one metal component from Group VIII or VIB of the periodic table. The Group VIII metal, preferably nickel, should be present in a concentration of about 0.5 to about 15 wt-% and the Group VIB metal, preferably tungsten, should be present in a concentration of about 0 to about 12 wt-%. The impregnation may be accomplished by any method known in the art, as for example, by spray impregnation wherein a solution containing the metal precursors in dissolved form is sprayed onto the support particles. Another method is the multi-dip procedure wherein the support material is repeatedly contacted with the impregnating solution with or without intermittent drying. Yet other methods involve soaking the support in a large volume of the impregnation solution or circulating the support therein, and yet one more method is the pore volume or pore saturation technique wherein support particles are introduced into an impregnation solution of volume just sufficient to fill the pores of the support. On occasion, the pore saturation technique may be modified, so as to utilize an impregnation solution having a volume between 10 percent less and 10 percent more than that which will just fill the pores.

If the active metal precursors are incorporated by impregnation, a subsequent or second calcination at elevated temperatures, such as, for example, between 399° C. (750° F.) and 760° C. (1400° F.), converts the metals to their respective oxide forms. In some cases, calcinations may follow each impregnation of individual active metals. A subsequent calcination yields a catalyst containing the active metals in their respective oxide forms.

A preferred first oligomerization catalyst of the present disclosure has an amorphous silica-alumina base impregnated with 0.5-15 wt-% nickel in the form of 3.175 mm (0.125 inch) extrudates and a density of about 0.45 to about 0.65 g/ml. It is also contemplated that metals can be incorporated onto the support by other methods such as ion-exchange and co-mulling.

The first oligomerization catalyst can be regenerated upon deactivation. Suitable regeneration conditions include subjecting the catalyst, for example, in situ, to hot air at about 400 to about 500° C. for 24 hours with 7% oxygen in the lab or commercially a coke burn at 0.5% oxygen for at least 24 hours with a proof burn at 7% oxygen until all coke is burnt.

To facilitate regeneration without downtime, a swing bed arrangement may be employed with an alternative first-stage oligomerization reactor. The regeneration gas may comprise air with an increased or decreased concentration of oxygen. Activity and selectivity of the regenerated catalyst is comparable to fresh catalyst.

The light oligomerized stream in the second light oligomerized line 52*b* has an increased concentration of ethylene dimers and oligomers compared to the first light olefin stream in line 25. The light oligomerized stream in the second light oligomerized line 52*b* may be let down in pressure and fed to the dealkanizer column 70.

Turning back to the heavy olefin stream in line 26 comprising a liquid C3+ olefins stream supplemented with liquefied heavy olefins in line 38, it is charged to a second oligomerization reactor 60 containing a second oligomerization catalyst to produce a heavy oligomerized stream. The supplemented heavy olefin stream in line 40 may be stored in a surge drum 41. From the surge drum 41, the supplemented heavy olefin stream in line 54 may be split into a first heavy olefin stream in line 54*a* and a second heavy olefin stream in line 54*b* to manage the exotherm across the second oligomerization reactor 60. The first heavy olefin stream in the first heavy olefin line 54*a* may be charged to a first catalyst bed 60*a* in the second oligomerization reactor 60 and the second heavy olefin stream in the second heavy olefin line 54*b* may be charged to a second catalyst bed 60*b* in the second oligomerization reactor 60. To further manage the exotherm in the second oligomerization reactor 60, the second diluent stream 44*b* is added to the first heavy olefin stream in line 54*a* to provide a dilute heavy olefin stream for charging to the second oligomerization reactor 60.

An unreacted olefin stream 78 is recovered downstream of the oligomerization section 10 in a dealkanizer column 70 and recycled back to the second oligomerization reactor 60 in line 56 to yield additional oligomers. The unreacted olefin stream may comprise C3 to C8 olefins. The unreacted olefin stream in line 56 may be split into a first unreacted olefin stream in line 56*a* and a second unreacted olefin stream in line 56*b*. The first unreacted olefin stream in line 56*a* may be added to the first heavy olefin stream in the first heavy olefin line 54*a* to provide an enhanced heavy olefin stream in line 58*a* before it is charged to the second oligomerization reactor 60. In the embodiment illustrated in FIG. 1, the second diluent stream in line 44*b* and the first unreacted olefin stream in line 56*a* are combined with the first heavy olefin stream in line 54*a* at the same location. Hence, line 58*a* carries the enhanced, diluted first heavy olefin stream to the second oligomerization reactor 60.

To achieve the most desirable olefin product, the second oligomerization reactor 60 is operated at a temperature from about 180° C. (356° F.) to about 250° C. (482° F.). The second oligomerization reactor 60 is run at a pressure from about 2.1 MPa (300 psig) to about 7.6 MPa (1100 psig), and more preferably from about 3.5 MPa (500 psig) to about 6.9 MPa (1000 psig).

The second oligomerization reactor 60 is not in downstream communication with the first oligomerization reactor 50 except through the diluent line 44 and the unreacted olefin line 56. The second oligomerization reactor 60 preferably operates in a down flow operation. However, upflow operation may be suitable. The dilute, enhanced first heavy olefin stream is contacted with the second oligomerization catalyst in the first catalyst bed 60*a* to oligomerize the C3+ olefins to provide distillate range olefins. With regard to the second oligomerization reactor 60, process conditions are selected to produce a higher percentage of jet range olefins which, when hydrogenated in a subsequent step as will be described below, result in a desirable jet-range hydrocarbon product. A predominance of the unconverted olefins charged to the second oligomerization reactor 60 are oligomerized.

The second oligomerization reactor 60 may comprise a second reactor vessel 61 comprising a first bed 60*a* of second oligomerization catalyst and a second bed 60*b* of second oligomerization catalyst. A first heavy oligomerized stream is discharged from the first bed 60*a* of second oligomerization catalyst in line 62*a* and is cooled. In an embodiment, the cooled, first heavy oligomerized stream in line 62*a* is mixed with the second heavy olefin stream in line 54*b* to provide a dilute second heavy olefin stream in line 58*b* that is charged to the second bed 60*b* of second oligomerization catalyst. In a further embodiment, the second unreacted olefin stream in line 56*b* is recycled to the second heavy olefin stream in line 54*b* to provide an augmented second heavy olefin stream in line 58*b* that is charged to the second bed 60*b* of second oligomerization catalyst.

In the embodiment illustrated in FIG. 1, the first heavy oligomerized stream in line 62*a* and the second unreacted olefin stream in line 56*b* are combined with the second heavy olefin stream in line 54*b* at the same location. Hence, line 58*b* carries the enhanced, dilute second heavy olefin stream to the second catalyst bed 60*b* in the second oligomerization reactor 60. A heavy oligomerized stream with an increased average carbon number greater than the charge supplemented heavy olefin stream in line 40 exits the second oligomerization reactor 60 in line 62*b*.

The second oligomerization catalyst may include a zeolitic catalyst. The second oligomerization catalyst may be considered a solid acid catalyst. The zeolite may comprise between about 5 and about 95 wt % of the catalyst, for example between about 5 and about 85 wt %. Suitable zeolites include zeolites having a structure from one of the following classes: MFI, MEL, ITH, IMF, TUN, FER, BEA, FAU, BPH, MEI, MSE, MWW, UZM-8, MOR, OFF, MTW, TON, MTT, AFO, ATO, and AEL. Three-letter codes indicating a zeotype are as defined by the Structure Commission of the International Zeolite Association and are maintained at http://www.iza-structure.org/databases. UZM-8 is as described in U.S. Pat. No. 6,756,030. In a preferred aspect, the first-stage oligomerization catalyst may comprise a zeolite with a framework having a ten-ring pore structure. Examples of suitable zeolites having a ten-ring pore structure include TON, MTT, MFI, MEL, AFO, AEL, EUO and FER. In a further preferred aspect, the first-stage oligomerization catalyst comprising a zeolite having a ten-ring pore structure may comprise a uni-dimensional pore structure. A uni-dimensional pore structure indicates zeolites containing non-intersecting pores that are substantially parallel to one of the axes of the crystal. The pores preferably extend through the zeolite crystal. Suitable examples of zeolites having a ten-ring uni-dimensional pore structure may include MTT. In a further aspect, the first-stage oligomerization catalyst comprises an MTT zeolite.

The second oligomerization catalyst may be formed by combining the zeolite with a binder, and then forming the catalyst into pellets. The pellets may optionally be treated with a phosphorus reagent to create a zeolite having a phosphorous component between 0.5 and 15 wt % of the treated catalyst. The binder is used to confer hardness and strength on the catalyst. Binders include alumina, aluminum phosphate, silica, silica-alumina, zirconia, titania and combinations of these metal oxides, and other refractory oxides, and clays such as montmorillonite, kaolin, palygorskite, smectite and attapulgite. A preferred binder is an aluminum-based binder, such as alumina, aluminum phosphate, silica-alumina and clays.

One of the components of the catalyst binder utilized in the present disclosure is alumina. The alumina source may be any of the various hydrous aluminum oxides or alumina gels such as alpha-alumina monohydrate of the bochmite or pseudo-bochmite structure, alpha-alumina trihydrate of the gibbsite structure, beta-alumina trihydrate of the bayerite structure, and the like. A suitable alumina is available from UOP LLC under the trademark VERSAL. A preferred alumina is available from Sasol North America Alumina Product Group under the trademark Catapal. This material is an extremely high purity alpha-alumina monohydrate (pseudo-bochmite) which after calcination at a high temperature has been shown to yield a high purity gamma-alumina.

A suitable second oligomerization catalyst is prepared by mixing proportionate volumes of zeolite and alumina to achieve the desired zeolite-to-alumina ratio. In an embodiment, the MTT content may about 5 to about 85, for example about 20 to about 82 wt % MTT zeolite, and the balance alumina powder will provide a suitably supported catalyst. A silica support is also contemplated.

Monoprotic acid such as nitric acid or formic acid may be added to the mixture in aqueous solution to peptize the alumina in the binder. Additional water may be added to the mixture to provide sufficient wetness to constitute a dough with sufficient consistency to be extruded or spray dried. Extrusion aids such as cellulose ether powders can also be added. A preferred extrusion aid is available from The Dow Chemical Company under the trademark Methocel.

The paste or dough may be prepared in the form of shaped particulates, with the preferred method being to extrude the dough through a die having openings therein of desired size and shape, after which the extruded matter is broken into extrudates of desired length and dried. A further step of calcination may be employed to give added strength to the extrudate. Generally, calcination is conducted in a stream of air at a temperature from about 260° C. (500° F.) to about 815° C. (1500° F.). The MTT catalyst is not selectivated to neutralize acid sites such as with an amine.

The extruded particles may have any suitable cross-sectional shape, i.e., symmetrical or asymmetrical, but most often have a symmetrical cross-sectional shape, preferably a spherical, cylindrical or polylobal shape. The cross-sectional diameter of the particles may be as small as 40 μm; however, it is usually about 0.635 mm (0.25 inch) to about 12.7 mm (0.5 inch), preferably about 0.79 mm (1/32 inch) to about 6.35 mm (0.25 inch), and most preferably about 0.06 mm (1/24 inch) to about 4.23 mm (1/6 inch).

In one exemplary embodiment, an MTT-type zeolite catalyst disposed on a high purity pseudo bochmite alumina substrate in a ratio of about 90/10 to about 20/80 and preferably between about 20/80 and about 50/50 is provided in a catalyst bed or more in the first-stage oligomerization reactor 22.

The second oligomerization catalyst can be regenerated upon deactivation. Suitable regeneration conditions include subjecting the second oligomerization catalyst, for example, in situ, to hot air at about 400 to about 500° C. for 24 hours with 7% oxygen. Commercial production may include coke burn with 0.5% oxygen for at least 24 hours and proof burn at 7% oxygen until all coke is burnt. To facilitate regeneration without downtime, a swing bed arrangement may be employed with an alternative second oligomerization reactor. A regeneration gas stream may be admitted to the second oligomerization reactor 60 requiring regeneration. The regeneration gas may comprise air with an increased or decreased concentration of oxygen. Activity and selectivity of the regenerated catalyst is comparable to fresh catalyst.

A parallel second oligomerization reactor may be used when the second oligomerization reactor 60 has deactivated during which the second oligomerization reactor 60 is regenerated in situ by combustion of coke from the catalyst. In another embodiment, the second oligomerization reactor 60 may comprise a lead reactor, a lag reactor and a spare reactor to facilitate regeneration. The additional reactors are not shown in FIG. 1.

The zeolite catalyst is advantageous as a second oligomerization catalyst. The zeolitic catalyst has relatively low sensitivity towards oxygenates contamination. Consequently, a smaller degree of removal of oxygenates is required of olefinic feed in line 12 if produced from an ethanol dehydration process.

The light oligomerized stream in line 52*b* may be let down in pressure and fed to a dealkanizer column 70. Additionally, the heavy oligomerized stream in line 62*b* may also be let down in pressure and fed to the dealkanizer column 70. In an embodiment, the light oligomerized stream in line 52*b* and the heavy oligomerized stream in line 62*b* are combined, to provide a mixed oligomerized stream in line 64, let down in pressure in a throttle valve 65 and fed to the dealkanizer column 70. The mixed oligomerized stream in line 64 may be at a temperature from about 160° C. (320° F.) to about 190° C. (374° F.) and a pressure of about 3.9 MPa (gauge) (550 psig) to about 7 MPa (gauge) (1000 psig). Additionally, the mixed oligomerized stream in line 64 can be routed to a dealkanizer surge drum (not shown) for proper pressure control of reactor section. A surge drum bottoms stream is let down in pressure through the control valve to produce a mixed oligomerized stream in line 65.

We have found that light alkanes such as ethane and/or propane are generated in the first oligomerization reactor 50 and/or the second oligomerization reactor 60 which must be removed from the oligomerate stream. Hence, the mixed oligomerized stream in line 64 is dealkanized by fractionation in a dealkanizer column 70 to provide a light alkane stream and a dealkanized stream. In an embodiment, the light alkane stream is an ethane stream in which case the dealkanizer column 70 is a deethanizer column. In another embodiment, the light alkane stream is a propane stream in which case the dealkanizer column 70 is a depropanizer column. In the dealkanizer column 70 light alkanes such as C3- and suitably C2-hydrocarbons, are separated perhaps in an alkane overhead stream in an overhead line 72 from perhaps a dealkanized bottoms stream in a bottoms line 74 comprising C4+ and suitably C3+ hydrocarbons. The dealkanizer column 70 may be operated at a bottoms temperature of between 149° C. (300° F.) to 293° C. (560° F.) and an overhead pressure ranging between about 345 kPa (g) (50 psig) to about 1.1 MPa (G) (160 psig).

The alkane overhead stream in the overhead line 72 may be chilled and separated in a dealkanizer receiver 76 to provide a dealkanized off-gas in an off-gas line 77. Condensate from the dealkanizer receiver 76 comprising C3-C8 olefins may be split with a reflux portion in line 75 refluxed back to the dealkanizer column 70. A recycle portion of the condensate may be recycled in line 78. The dealkanized stream perhaps in the bottoms line 74 may be split between a reboil stream in line 80 which is reboiled by heat exchange with a first hot diesel stream in line 82, perhaps taken from a jet fractionator bottom heat exchange stream in the jet bottoms heat exchange line 74 in FIG. 2, and a net bottoms stream in line 84 which may be let down in pressure, heated by heat exchange with the olefin splitter bottoms stream in line 90 and fed to an olefin splitter column 86. The cooled first hot diesel stream is removed in line 83. The reboiled bottom stream in line 80 may be returned boiling to the dealkanizer column 70 to provide heating requirements. In some embodiments, the feed may be preheated by the olefin splitter column bottom or reboiled by high pressure steam.

The dealkanized stream in the dealkanizer net bottoms line 84 is split by fractionation in an olefin splitter column 86 into an overhead olefin stream perhaps in an olefin splitter overhead line 88 and a bottoms olefin stream perhaps in an olefin splitter bottoms line 90. The olefin splitter overhead stream may be cooled to about 31° C. (88° F.) to about 93° C. (200° F.) to provide a fully condensed stream from an olefin splitter receiver 92. The overhead olefin condensate from a bottom of the olefin splitter receiver 92 may be split between a reflux stream that is refluxed back to the column in line 93 and an unreacted olefin recycle stream in a recycle line 94 that may be recycled to the second oligomerization reactor 60.

The first unreacted olefin stream in line 78 and the second unreacted olefin stream in line 94 may be combined to provide a recycle stream in line 96. The recycle unreacted olefin stream in line 96 may be recycled to the second oligomerization reactor 60 to oligomerize the C3-C8 olefins. The stream in line 96 may be fed to a surge drum 97, pumped and split into a drag stream in line 98 that is fed to the hydrogenation unit in FIG. 2 and the unreacted olefin stream in line 56.

The bottoms olefin stream in the splitter bottoms line 90 may be split between a reboil stream in a splitter reboil line 91 that is reboiled by heat exchange with a second hot diesel stream in line 173 perhaps taken from the jet fractionator bottom heat exchange stream in the jet bottoms heat exchange line 74 and fed back to the olefin splitter column 86. The cooled second hot diesel stream in line 162 is returned back to the hydrogenation section 110 in FIG. 2 to be reboiled and fed back to the jet fractionation column 150. A bottoms olefin stream in a net bottoms line 99 may be cooled by heat exchange with the net dealkanized bottoms stream in line 84 before it is transported to the hydrogenation section 110 in FIG. 2. The heavy olefin stream comprises C8+ olefins that once cooled can be transported to the hydrogenation section.

Turning to the hydrogenation section in FIG. 2, the bottoms olefin stream in the net olefin splitter bottoms line 99 from FIG. 1 comprising distillate-range C8+ oligomerized olefins may be hydrogenated to saturate the olefinic bonds in a hydrogenation reactor 120 to provide fuels. This step is performed to ensure the product motor fuel meets or exceeds the thermal oxidation requirements specified in ASTM D7566-10a for hydroprocessed synthesized paraffinic kerosene (SPK). Additionally, saturating the oligomerized heavy olefins will provide the paraffin stream that may be used as the diluent stream in line 44. The bottoms olefin stream in line 99 may be cooled to produce steam and be combined with the unreacted olefin stream comprising C2 to C8 olefins in line 98 also from FIG. 1 to produce a combined olefin stream in line 106. The combined olefin stream in line 106 may also be combined with a hydrogen stream in line 108 to provide a combined hydrogenation charge stream in line 112 which is cooled and charged to the hydrogenation reactor 120 at 125° C. (257° F.) to about 204° C. (400° F.) and 3.5 MPa (500 psig) to about 6.9 MPa (1000 psig). An excess of hydrogen may be employed to ensure complete saturation such as about 1.5 to about 2.5 of stochiometric hydrogen.

Hydrogenation is typically performed using a conventional hydrogenation or hydrotreating catalyst, and can include metallic catalysts containing, e.g., palladium, rhodium, nickel, ruthenium, platinum, rhenium, cobalt, molybdenum, or combinations thereof, and the supported versions thereof. Catalyst supports can be any solid, inert substance including, but not limited to, oxides such as silica, alumina, titania, calcium carbonate, barium sulfate, and carbons. The catalyst support can be in the form of powder, granules, pellets, or the like.

In an exemplary embodiment, hydrogenation is performed in the hydrogenation reactor 120 that includes a platinum-on-alumina catalyst, for example about 0.5 wt % to about 0.9 wt % platinum-on-alumina catalyst. The hydrogenation reactor 120 converts the olefins into a paraffin product having the same carbon number distribution as the olefins, thereby forming distillate-range paraffins suitable for use as jet and diesel fuel.

The hydrogenated heavy stream discharged from the hydrogenation reactor 120 in line 123 may be separated in a hot separator 122. In the hot separator 122, the hydrogenated heavy stream is separated into a hot hydrogenated vapor stream in an overhead line 124 and a hot hydrogenated liquid stream in the hot separator bottoms line 126. The hydrogenated heavy liquid stream in the bottoms line 126 may be heated by heat exchange with the diluent stream in line 44 before the diluent stream is recycled to the oligomerization section 10 in FIG. 1. The heated hydrogenated heavy liquid stream in the hot bottoms line 126 may be fed to a stripper column 130. The hot separator 122 may be operated at a temperature of about 204° C. (400° F.) to about 343° C. (650° F.) and a pressure of about (600 psig).

The hot hydrogenated vapor stream in the hot overhead line 124 may be cooled and fed to a cold separator 128. The cold separator 128 separates the hot hydrogenated vapor stream in the hot overhead line 124 into a cold vapor stream in a cold overhead line 127 and a cold heavy liquid stream in a cold bottoms line 129. The streams may be combined or fed to the stripper column 130 separately. A purge in line 125 may be taken from the hydrogenated cold vapor stream in line 127 and the remainder may be compressed and combined with make-up hydrogen in line 114 to provide the hydrogen stream in line 108. The cold hydrogenated heavy liquid stream in the bottoms line 129 may be sent to the stripping column 130 at a feed location above that for the hot hydrogenated heavy liquid stream in the hot separator bottoms line 126. The cold separator may be operated at a temperature of about 46° C. (115° F.).

The stripping column 130 may be a flash stripper to remove gases from the hot hydrogenated liquid stream in the hot bottoms line 126 and the cold hydrogenated liquid stream in the cold bottoms line 129. The stripping column 130 removes residual gases from the liquid stream to provide a stripper overhead stream in a stripper overhead line 132 and a stripped bottom stream in a stripper bottoms line 134. The stripper overhead stream in the overhead line 132 is cooled and separated in a stripper receiver 136 to provide a stripper off-gas stream in a stripper receiver overhead line 137 and a condensate stream in line 138 which is refluxed to the column. The stripping column 130 may be operated at a bottom temperature of about 232° C. (450° F.) to about 327° C. (620° F.) and an overhead pressure of about 210 kPa (g) (30 psig) to about 700 kPa (g) (100 psig).

The stripped fuel stream in the stripper bottoms line 134 may be fed to the jet fractionation column 150 after undergoing stripping to remove volatiles in the stripping column 130 without further heating. Alternatively, the stripping column 130 may be omitted upstream of the jet fractionation column 150. In the jet fractionation column 150, the stripped fuel stream may be separated into a jet off-gas stream in an overhead line 152, a green jet stream in a side line 154 from a side of the jet fractionation column 150 and a green diesel stream in a bottoms line 156. A liquid product stream from the jet fractionator overhead receiver may also be obtained. The jet fractionation column 150 may be operated at a bottom temperature of about 288° C. (550° F.) to about 422° C. (792° F.) and an overhead pressure of about 35 kPa (5 psig) to about 350 kPa (50 psig). The jet fractionation overhead stream in the overhead line 152 may be cooled and a resulting condensate portion refluxed from a jet fractionation receiver 158 back to the jet fractionation column 150 in line 159 while a net off gas stream comprising C8-hydrocarbons is taken in a receiver overhead line 155 from the jet fractionation receiver 158. Most of the hydrocarbons in the net off gas stream in the receiver overhead line 155 are lighter hydrocarbons and can be used to fuel the reboiler 166 for the jet fractionation column 150. To control flash point of the jet fuel, a net receiver liquid draw can also be taken which can also be used as fuel oil in fired heaters or alternatively can be added to the gasoline pool.

The green jet stream taken in the side line 154 comprises kerosene range C9-C19 hydrocarbons and may be cooled and taken as a jet fuel product meeting applicable SPK standards. In an alternative embodiment, the green jet stream may be taken from the condensate stream in line 159 from the jet fractionation receiver 158 instead of refluxing all of the condensate to the column. This green jet stream taken from line 159 may have to be further stripped to remove light ends. In such an embodiment, no side line 154 would be taken to recover the green jet fuel stream.

The green diesel bottoms stream in the bottoms line 156 may be split between a reboil diesel stream in line 157 and a diesel product stream in line 164. The reboil diesel stream in line 157 is split into the jet bottoms heat exchange stream 74 and a bypass bottoms stream in the bottoms bypass line 161. The jet bottoms heat exchange stream in the jet bottoms heat exchange line 74 may be split to provide a first a first hot diesel stream in line 82 and a second hot diesel stream in line 173 to provide reboil heat to the dealkanizer column 70 and the olefin splitter column 86, respectively, in FIG. 1. Either the bypass bottoms stream in line 161 through a valve thereon or the cooled second hot diesel stream in line 162 from FIG. 1 or some of both is taken in a jet reboil line 163 and reboiled in a fired heater 166 and fed back to the jet fractionation column 150.

The diesel product stream in line 164 is split between a diesel product stream in a diesel product line 118 and the diluent stream in line 44. A diesel product may also be taken from a reboiler liquid loop in line 161. The diluent stream in line 44 may be cooled by heat exchange with the hot hydrogenated heavy liquid stream in the hot separator bottoms line 126 and recycled back to be mixed with the light olefin stream in line 42*a* and the heavy olefin stream in line 54*a* in the oligomerization section 10 in FIG. 1. The green diesel stream in the diluent line 44 is paraffinic, so it will be inert to the dimerization, oligomerization and hydrogenation reactions to which it may be subject. The diesel product stream in the diesel product line 118 may be cooled and fed to the diesel pool. The diesel stream will meet ASTM D975 standards for diesel.

Starting with olefins, the disclosed process can efficiently produce green jet fuel and green diesel fuel that meets applicable fuel requirements while managing exothermic heat generation. Carbon recovery in the process can exceed 95%. Both the jet fuel stream in the side line 154 and the diesel product stream in line 118 can be cooled and fed to their respective fuel pools.

EXAMPLE

We simulated the disclosed parallel two-stage oligomerization process and compared it to a serial two-stage process to determine advantages of the parallel process. The serial process simulated charged all the olefin feed first to the first-stage oligomerization reactor and all the first stage oligomerate was then charged to the second-stage oligomerization reactor. The parallel process simulated charged all the ethylene feed to the first oligomerization reactor and charged all the C3+ olefin feed to a second oligomerization reactor. In both cases, light oligomerate was recycled to the second-stage oligomerization reactor.

Simulated with a nickel catalyst weight hourly space velocity of 1 $hr^{-1}$ we found that nickel catalyst volume was reduced by 65% and zeolitic catalyst was reduced by 35%. Additionally, the power to run the ethylene compressor was reduced by 13% while the power to run the regeneration gas compressor was reduced by 11%. The resulting savings from these capital and operational expense reductions are significant, too our surprise.

SPECIFIC EMBODIMENTS

While the following is described in conjunction with specific embodiments, it will be understood that this description is intended to illustrate and not limit the scope of the preceding description and the appended claims.

A first embodiment of the disclosure is a process for oligomerizing an olefin stream comprising charging a light olefin stream comprising a vaporous C2 olefin stream to a first oligomerization reactor containing a first oligomerization catalyst to produce a light oligomerized stream; and charging a heavy olefin stream comprising a liquid C3+ olefins stream to a second oligomerization reactor containing a second oligomerization catalyst to produce a heavy oligomerized stream. An embodiment of the disclosure is one, any or all of prior embodiments in this paragraph up through the first embodiment in this paragraph wherein the light olefin stream is expanded to provide an expanded light olefin stream and a light liquid stream is separated from the expanded light olefin stream to provide a dry light olefin stream and the light liquid stream is added to the heavy olefin stream to provide a supplemented heavy olefin stream. An embodiment of the disclosure is one, any or all of prior embodiments in this paragraph up through the first embodiment in this paragraph wherein the light olefin stream is compressed to provide a compressed light olefin stream before it is charged to the first oligomerization reactor. An embodiment of the disclosure is one, any or all of prior embodiments in this paragraph up through the first embodiment in this paragraph wherein the light olefin stream is split into a first light olefin stream and a second light olefin stream; and the first light olefin stream is charged to a first catalyst bed in the first oligomerization reactor and the second light olefin stream is charged to a second catalyst bed in the first oligomerization reactor. An embodiment of the disclosure is one, any or all of prior embodiments in this paragraph up through the first embodiment in this paragraph wherein a paraffinic diluent stream is added to the first light olefin stream to provide a dilute first light olefin stream and charging the dilute first light olefin stream to the first oligomerization reactor. An embodiment of the disclosure is one, any or all of prior embodiments in this paragraph up through the first embodiment in this paragraph wherein the first light olefin stream contacts the first oligomerization catalyst in the first catalyst bed in the first oligomerization reactor and produces a first light oligomerized stream; the first light oligomerized stream mixes with the second light olefin stream to provide a dilute second light olefin stream and the dilute second light olefin stream is charged to the second catalyst bed in the first oligomerization reactor. An embodiment of the disclosure is one, any or all of prior embodiments in this paragraph up through the first embodiment in this paragraph wherein the supplemented second stream is charged to the second oligomerization reactor. An embodiment of the disclosure is one, any or all of prior embodiments in this paragraph up through the first embodiment in this paragraph wherein the heavy olefin stream is split into a first heavy olefin stream and a second heavy olefin stream; and the first heavy olefin stream is charged to a first catalyst bed in the second oligomerization reactor and the second heavy olefin stream is charged to a second catalyst bed in the second oligomerization reactor. An embodiment of the disclosure is one, any or all of prior embodiments in this paragraph up through the first embodiment in this paragraph wherein a paraffinic diluent stream is added to the supplemented heavy olefin stream to provide a diluted heavy olefin stream and charging the diluted heavy olefin stream to the second oligomerization reactor. An embodiment of the disclosure is one, any or all of prior embodiments in this paragraph up through the first embodiment in this paragraph comprising recycling a first unreacted olefin stream to the first heavy olefin stream to provide an augmented first heavy olefin stream and charging the augmented first heavy olefin stream to the first catalyst bed in the second oligomerization reactor and recycling a second unreacted olefin stream to the second heavy olefin stream to provide an augmented second heavy olefin stream and charging the augmented second heavy olefin stream to the second catalyst bed in the second oligomerization reactor. An embodiment of the disclosure is one, any or all of prior embodiments in this paragraph up through the first embodiment in this paragraph wherein the first heavy olefin stream contacts the second oligomerization catalyst in the first catalyst bed in the second oligomerization reactor and produces a first heavy oligomerized stream; the first heavy oligomerized stream mixes with the second heavy olefin stream to provide a dilute second heavy olefin stream and the dilute second heavy olefin stream is charged to the second catalyst bed in the second oligomerization reactor. An embodiment of the disclosure is one, any or all of prior embodiments in this paragraph up through the first embodiment in this paragraph wherein the first olefin stream may be taken from a deethanizer overhead stream. An embodiment of the disclosure is one, any or all of prior embodiments in this paragraph up through the first embodiment in this paragraph wherein the heavy olefin stream may be taken from a deethanizer bottoms stream. An embodiment of the disclosure is one, any or all of prior embodiments in this paragraph up through the first embodiment in this paragraph wherein the first catalyst is a metal catalyst. An embodiment of the disclosure is one, any or all of prior embodiments in this paragraph up through the first embodiment in this paragraph wherein the second catalyst is a zeolitic catalyst. An embodiment of the disclosure is one, any or all of prior embodiments in this paragraph up through the first embodiment in this paragraph further comprising feeding the light oligomerized stream and the heavy oligomerized stream to a fractionation column to produce an unreacted olefin stream from which the first unreacted olefin stream is taken. An embodiment of the disclosure is one, any or all of prior embodiments in this paragraph up through the first embodiment in this paragraph further comprising producing a bottom stream from said fractionation column and fractionating the bottom stream to produce a second unreacted olefin stream and recycling the second unreacted olefin stream with the first unreacted olefin stream.

A second embodiment of the disclosure is a process for oligomerizing an olefin stream comprising charging a light olefin stream comprising vaporous C2 olefin to a first oligomerization reactor containing a first oligomerization catalyst to produce a light oligomerized stream; and charging a heavy olefin stream comprising a liquid C3+ olefins stream to a second oligomerization reactor containing a second oligomerization catalyst to produce a heavy oligomerized stream; and fractionating the light oligomerized stream and the heavy oligomerized stream to produce an unreacted olefin stream and a olefin splitter bottom stream. An embodiment of the disclosure is one, any or all of prior embodiments in this paragraph up through the second embodiment in this paragraph further comprising recycling an unreacted olefin stream to the heavy olefin stream to provide an augmented heavy olefin stream and charging the augmented heavy olefin stream to the second oligomerization reactor.

A third embodiment of the disclosure is a process for oligomerizing an olefin stream comprising separating a light olefin stream comprising vaporous C2 olefin to provide a dry light olefin stream and a light liquid olefin stream; adding the light liquid olefin stream to a heavy olefin stream comprising liquid C3+ olefins to provide a supplemented heavy olefin stream; charging the dry light olefin stream to a first oligomerization reactor containing a first oligomerization catalyst to produce a light oligomerized stream; and charging the supplemented heavy olefin stream to a second oligomerization reactor containing a second oligomerization catalyst to produce a heavy oligomerized stream. An embodiment of the disclosure is one, any or all of prior embodiments in this paragraph up through the third embodiment in this paragraph further comprising fractionating the light oligomerized stream and the heavy oligomerized stream together.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for oligomerizing an olefin stream comprising:

charging a light olefin stream comprising a vaporous C2 olefin stream to a first oligomerization reactor containing a first oligomerization catalyst to produce a light oligomerized stream, wherein the first oligomerization catalyst is an amorphous silica-alumina base with a metal from either Group VIII and/or Group VIB; and charging a heavy olefin stream comprising a liquid C3+ olefins stream to a second oligomerization reactor containing a second oligomerization catalyst to produce a heavy oligomerized stream.

2. The process of claim 1 wherein said light olefin stream is expanded to provide an expanded light olefin stream and a light liquid stream is separated from said expanded light olefin stream to provide a dry light olefin stream and said light liquid stream is added to said heavy olefin stream to provide a supplemented heavy olefin stream.

3. The process of claim 1 wherein said light olefin stream is compressed to provide a compressed light olefin stream before it is charged to said first oligomerization reactor.

4. The process of claim 1 wherein said light olefin stream is split into a first light olefin stream and a second light olefin stream; and the first light olefin stream is charged to a first catalyst bed in said first oligomerization reactor and the second light olefin stream is charged to a second catalyst bed in said first oligomerization reactor.

5. The process of claim 4 wherein a paraffinic diluent stream is added to said first light olefin stream to provide a dilute first light olefin stream and charging said dilute first light olefin stream to said first oligomerization reactor.

6. The process of claim 5 wherein said first light olefin stream contacts said first oligomerization catalyst in said first catalyst bed in said first oligomerization reactor and produces a first light oligomerized stream; the first light oligomerized stream mixes with the second light olefin stream to provide a dilute second light olefin stream and said dilute second light olefin stream is charged to said second catalyst bed in said first oligomerization reactor.

7. The process of claim 2 wherein said supplemented second stream is charged to said second oligomerization reactor.

8. The process of claim 1 wherein said heavy olefin stream is split into a first heavy olefin stream and a second heavy olefin stream; and the first heavy olefin stream is charged to a first catalyst bed in said second oligomerization reactor and the second heavy olefin stream is charged to a second catalyst bed in said second oligomerization reactor.

9. The process of claim 7 wherein a paraffinic diluent stream is added to said supplemented heavy olefin stream to provide a diluted heavy olefin stream and charging said diluted heavy olefin stream to said second oligomerization reactor.

10. The process of claim 9 comprising recycling a first unreacted olefin stream to said first heavy olefin stream to provide an augmented first heavy olefin stream and charging said augmented first heavy olefin stream to said first catalyst bed in said second oligomerization reactor and recycling a second unreacted olefin stream to said second heavy olefin stream to provide an augmented second heavy olefin stream and charging said augmented second heavy olefin stream to said second catalyst bed in said second oligomerization reactor.

11. The process of claim 10 wherein said first heavy olefin stream contacts said second oligomerization catalyst in said first catalyst bed in said second oligomerization reactor and produces a first heavy oligomerized stream; the first heavy oligomerized stream mixes with the second heavy olefin stream to provide a dilute second heavy olefin stream and said dilute second heavy olefin stream is charged to said second catalyst bed in said second oligomerization reactor.

12. The process of claim 1 wherein said first olefin stream may be taken from a deethanizer overhead stream.

13. The process of claim 1 wherein said heavy olefin stream may be taken from a deethanizer bottoms stream.

14. The process of claim 1 wherein said first catalyst is a metal catalyst.

15. The process of claim 1 wherein said first catalyst is a zeolite catalyst.

16. The process of claim 10 further comprising feeding said light oligomerized stream and said heavy oligomerized stream to a fractionation column to produce an unreacted olefin stream from which said first unreacted olefin stream is taken.

17. The process of claim 1 further comprising producing a bottom stream from said fractionation column and fractionating the bottom stream to produce a second unreacted olefin stream and recycling the second unreacted olefin stream with the first unreacted olefin stream.

18. The process of claim 17 further comprising recycling an unreacted olefin stream to said heavy olefin stream to provide an augmented heavy olefin stream and charging said augmented heavy olefin stream to said second oligomerization reactor.

19. A process for oligomerizing an olefin stream comprising:

charging a light olefin stream comprising vaporous C2 olefin to a first oligomerization reactor containing a first oligomerization catalyst to produce a light oligomerized stream, wherein the light olefin stream is charged at a temperature of about 80° C. (176° F.) to about 200° C. (392° F.); and charging a heavy olefin stream comprising a liquid C3+ olefins stream to a second oligomerization reactor containing a second oligomerization catalyst to produce a heavy oligomerized stream; and fractionating said light oligomerized stream and said heavy oligomerized stream to produce an unreacted olefin stream and an olefin splitter bottom stream.

20. A process for oligomerizing an olefin stream comprising:

separating a light olefin stream comprising vaporous C2 olefin to provide a dry light olefin stream and a light liquid olefin stream;

adding said light liquid olefin stream to a heavy olefin stream comprising liquid C3+ olefins to provide a supplemented heavy olefin stream;

charging said dry light olefin stream to a first oligomerization reactor containing a first oligomerization catalyst to produce a light oligomerized stream;

charging said supplemented heavy olefin stream to a second oligomerization reactor containing a second oligomerization catalyst to produce a heavy oligomerized stream, and feeding the light oligomerized stream and the heavy oligomerized stream to a dealkanizer column to recover an unreacted olefin stream, wherein the unreacted olefin stream is recycled back to the second oligomerization reactor.

* * * * *